US009211973B2

(12) United States Patent
Osborn

(10) Patent No.: US 9,211,973 B2
(45) Date of Patent: Dec. 15, 2015

(54) INFORMATIVE PACKAGING AND WRAPPING PRODUCT

(75) Inventor: Michael J. Osborn, Oakland, CA (US)

(73) Assignee: Wine.com, Inc., San Francisco, CA (US)

( * ) Notice: Subject to any disclaimer, the term of this patent is extended or adjusted under 35 U.S.C. 154(b) by 238 days.

(21) Appl. No.: 13/286,158

(22) Filed: Oct. 31, 2011

(65) Prior Publication Data

US 2013/0105350 A1 May 2, 2013

(51) Int. Cl.

*B65D 85/00* (2006.01)
*B65D 5/50* (2006.01)
*B65D 5/42* (2006.01)

(52) U.S. Cl.

CPC ..... *B65D 5/5035* (2013.01); *B65D 5/4233* (2013.01)

(58) Field of Classification Search

CPC .. B65D 25/205; B65D 25/36; B65D 2203/00; B65D 5/503

USPC ..... 206/459.5, 459.1, 139, 216, 217, 522, 206/427–435, 815, 521, 591, 593, 594, 206/585; 229/117.28, 118, 922, 923, 229/120.32, 120.24, 164.2, 164.1

See application file for complete search history.

(56) References Cited

U.S. PATENT DOCUMENTS

| | | | | | |
|---|---|---|---|---|---|
| 1,693,622 | A * | 12/1928 | Spaulding | 206/732 |
| 1,859,523 | A * | 5/1932 | Rodgers | 229/125.11 |
| 2,837,216 | A * | 6/1958 | Paige | 206/736 |
| 2,840,293 | A * | 6/1958 | Paige | 206/736 |
| 3,123,207 | A * | 3/1964 | Goldstein | 206/763 |
| 3,152,687 | A * | 10/1964 | Goldstein | 206/745 |
| 3,300,041 | A * | 1/1967 | Fuller | 206/161 |
| 3,987,897 | A * | 10/1976 | Smith | 206/226 |
| 5,582,293 | A * | 12/1996 | Kay | 206/457 |
| 5,622,264 | A * | 4/1997 | Wetterlund | 206/765 |
| 6,158,579 | A * | 12/2000 | Rosenbaum | 206/45.29 |
| 6,293,405 | B1 * | 9/2001 | Burch, Jr. | 206/767 |
| 6,296,121 | B1 * | 10/2001 | Hershey | 206/701 |
| 6,990,786 | B2 * | 1/2006 | Kilmartin | 53/411 |
| 7,723,600 | B2 * | 5/2010 | Braun et al. | 84/483.2 |
| 2004/0159567 | A1 * | 8/2004 | Miziolek et al. | 206/427 |
| 2005/0139502 | A1 * | 6/2005 | Andersen et al. | 206/427 |
| 2009/0194172 | A1 * | 8/2009 | Lymn et al. | 137/343 |
| 2009/0266723 | A1 * | 10/2009 | Yahiel | 206/223 |

* cited by examiner

*Primary Examiner* — Jacob K Ackun
*Assistant Examiner* — Jenine Pagan
(74) *Attorney, Agent, or Firm* — Nixon Peabody LLP

(57) ABSTRACT

An informative packaging and wrapping product is described. The informative packaging and wrapping product includes a presentation surface and an informational surface coupled to the presentation surface that together form a packaging insert. The packaging insert is configured to reside within a shipping container. The packaging insert is configured to cover at least a portion of goods within the shipping container.

3 Claims, 7 Drawing Sheets

INFORMATIVE PACKAGING AND WRAPPING PRODUCT

FIELD

Embodiments of the invention relate to packaging. In particular, embodiments of the invention relate to an informative packaging and wrapping product.

BACKGROUND

Current shipping techniques involve loading goods for shipping into a shipping container, such as a box or crate. The shipping container is designed to offer some protection to the goods and to organize one or more goods into a discrete unit for shipping efficiency. The shipping box may also include packaging materials designed to minimize damage to the goods. But, these packaging materials do not provide a way to maintain the packaging materials in the shipping container once the box is opened. In addition, current packaging materials do not provide a unified surface to cover the packaging materials and the goods for presenting information.

SUMMARY

An informative packaging and wrapping product is described. The informative packaging and wrapping product includes a presentation surface and an informational surface coupled to the presentation surface that together form a packaging insert. The packaging insert is configured to reside within a shipping container. The packaging insert is configured to cover at least a portion of goods within the shipping container.

Other features and advantages of embodiments will be apparent from the accompanying drawings and from the detailed description that follows.

BRIEF DESCRIPTION OF THE DRAWINGS

Embodiments are illustrated by way of example and not limitation in the figures of the accompanying drawings, in which like references indicate similar elements and in which.

DETAILED DESCRIPTION

Embodiments of an informative packaging and wrapping product are described. In particular, embodiments of an informative packaging and wrapping product that is configured to reside inside a shipping container to cover goods. Embodiments include an informative packaging and wrapping product configured to cover goods including, but not limited to, merchandizing, bottles, wine, wine related merchandizing, glasses, confectioneries, cheese, food, chocolates, gift boxes, or other items for shipping. A shipping container may include, but is not limited to, a box, a crate, a tin, a mailer, or any other container suitable for shipping or storing goods. Some embodiments of the informative packaging and wrapping product are configured to cover a significant portion of the goods within a shipping container to provide a visible, uniform surface when the shipping container is opened.

According to embodiments, the uniform surface of the informative packaging and wrapping product acts as a physical barrier to prevent shipping packaging materials inserted around and between goods inside the shipping container from shifting and spilling out. Packaging materials may include, but are not limited to, packing peanuts, foam, bubble wrap, paper cushioning, corrugated inserts, Kraft paper, air filled cushion, pulp, egg crate material or other cushioning product. For some embodiments, the uniform surface over the goods is configured in such a way as to act as wrapping for the goods, one such embodiment is a wrapping product. For certain embodiments of a wrapping product, the uniform surface and coverage over the goods gives the impression that the goods have been wrapped with gift wrapping paper or another decorative covering. This provides a welcoming experience to a person opening the shipping container. As such, some embodiments include a graphic on the presentation surface of an informative packaging and wrapping product to resemble gift wrapping paper. According to other embodiments, the uniform service may include a graphic or other illustration to give a context for the goods inside the container. For a particular embodiment, the informative packaging and wrapping product is configured for shipping with wine bottles and wine related goods. According to some embodiments, the informative packaging and wrapping product may be made from paper. cardboard, card stock, plastic, metal, foil or other material.

Figure 1:
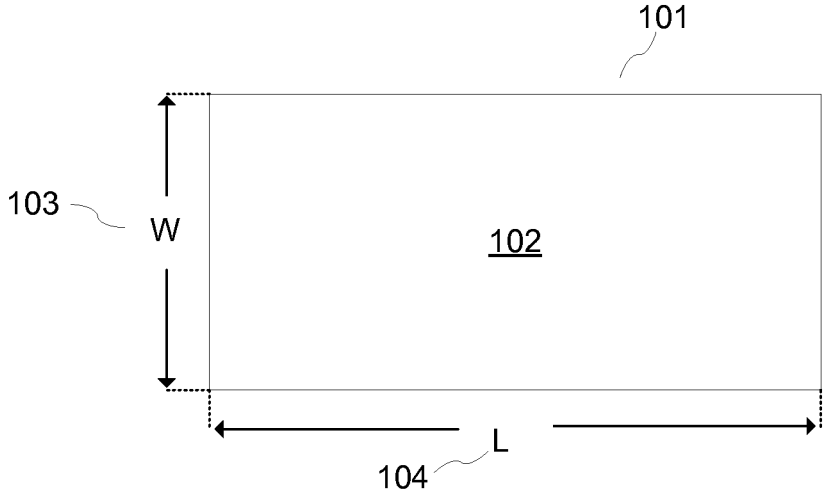
FIG. 1 illustrates a top view of an embodiment of an informative packaging and wrapping product.

FIG. 1 illustrates a top view of an embodiment of an informative packaging and wrapping product. According to the embodiment, the informative packaging and wrapping product 101 includes a first surface 102. First surface 102, according to some embodiments, is a presentation surface that will face away from the goods in the shipping container such that a person opening the shipping container will be able to view the presentation surface. According to some embodiments, the presentation surface includes one or more graphics related to one or more of the goods contained in the shipping container. For an informative packaging and wrapping product 101 configured for shipping wine, the one or more graphics on the presentation surface may relate to wine including, but not limited to, grapes, flags of regions, logo of product or seller, maps of wine regions, classifications for wine, wine varietals or other graphics related to wine.

The informative packaging and wrapping product 101 also includes a width ("W") 103 and a length ("L") 104. According to an embodiment the width 103 and the length 104 are configured to fit inside a shipping container such that the informative packaging and wrapping product 101 covers the goods within the shipping container. As such, the dimensions of the informative packaging and wrapping product 101 may be configured to fit within any size or shape shipping container. According to some embodiments, the width 103 and length 104 are configured to fit inside a shipping container to almost completely fill an opening in the shipping container. For some embodiments the width 103 of the informative packaging and wrapping product 101 is in a range including 6 inches up to and including 2 feet. Similarly, the length 104 of the informative packaging and wrapping product 101 is in the range including 6 inches up to and including 2 feet. For a particular embodiment, the width 103 is approximately 9 inches and the length 104 is approximately 13 inches. Another embodiment includes an informative packaging and wrapping product 101 having a width 103 of approximately 10 inches and a length 104 of approximately 15 inches. Yet another embodiment includes an informative packaging and wrapping product 101 having a width 103 of approximately 12 inches and a length 104 of approximately 19 inches.

Figure 2:
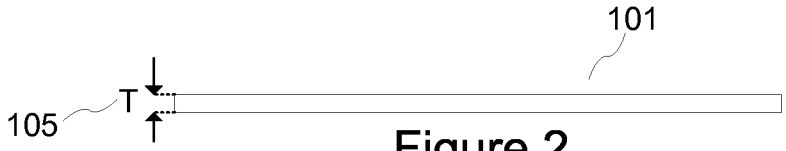
FIG. 2 illustrates a side view of an embodiment of an informative packaging and wrapping product.
Figure 3:
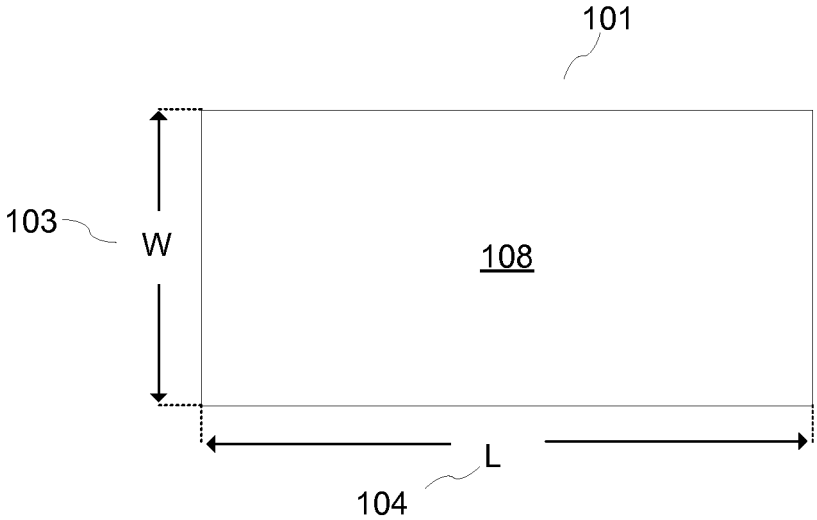
FIG. 3 illustrates a bottom view of an embodiment of an informative packaging and wrapping product.

FIG. 2 illustrates a side view of an embodiment of an informative packaging and wrapping product 101. For an embodiment, the informative packaging product and wrapping product 101 has a thickness ("T") 105 in a range from 0.0032 inches up to and including 0.125 inches. Other embodiments include a thickness greater than 0.125 inches. FIG. 3 illustrates a bottom view of an embodiment of an informative packaging and wrapping product 101. For an embodiment, the informative packaging and wrapping product 101 includes a second surface 108. Second surface 108, according to some embodiments, is an informational surface that may include information related to the goods included in the shipping container. An example of an informative packaging and wrapping product 101 is one configured to ship with wine. For such an example, the informational surface may include characteristics of the wine, information about the region the wine is from, information on recipes that pair well with the wine, wine varietal, coupons, vouchers, vouchers for wine tastings, or other information related to wine or other goods. According to an embodiment the second surface 108 is configured to be placed facing the goods in the shipping container. For some embodiments, the second surface 108 may also include one or more graphics.

Figure 4:
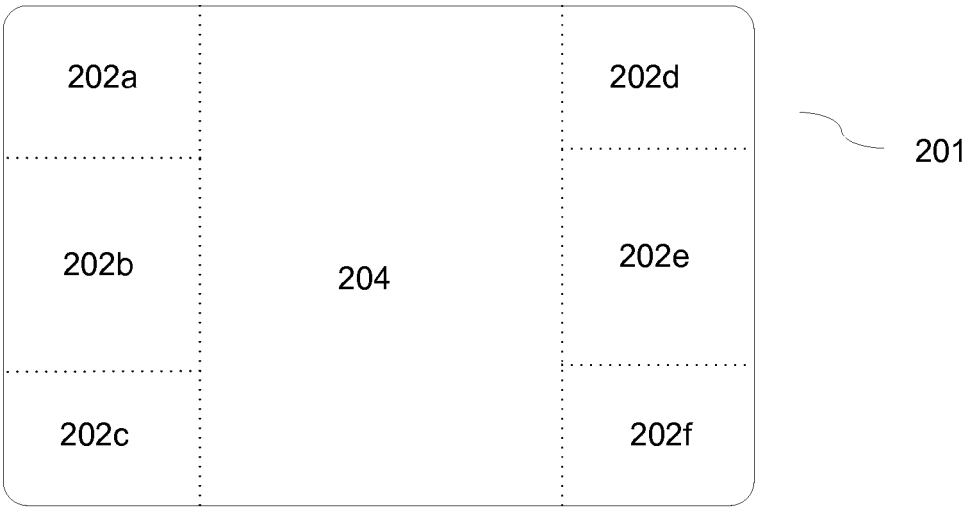
FIG. 4 illustrates an embodiment of an informative packaging and wrapping product including detachably connected sections.

FIG. 4 illustrates an embodiment of an informative packaging and wrapping product 201 including detachably connected sections 202*a-f*. According to an embodiment, the informative packaging and wrapping product 201 may be perforated or precut to create sections that tear away from or are otherwise detachable. For some embodiments, the detachably connected sections 202*a-f* may be arranged in columns. In another embodiment, the detachably connected sections 202*a-f* may be arranged in rows. For an embodiment each row or column may be dedicated to a specific type of information on the informational surface of an informative packaging and wrapping product.

For example, the column including detachably connected sections 202*a-c* in the embodiment illustrated in FIG. 4 may be dedicated to information on wine regions related to a wine contained in the shipping container. For other embodiments, sections 202*a-c* may include information related to characteristics of the wine, information about the region the wine is from, information on recipes that pair well with the wine, wine varietal, coupons, vouchers, vouchers for wine tastings, or other information related to wine or other goods. In such an example, the column including 202*d-f* may include information related to recipes that pair with wines included in the shipping container. For other embodiments, sections 202*d-f* may include information related to characteristics of the wine, information about the region the wine is from, information on recipes that pair well with the wine, wine varietal, coupons, vouchers, vouchers for wine tastings, or other wine or goods related information. The center column 204, in continuing with the example, may include a map pointing out geographic locations of wines included in the shipping container. For other embodiments, center column 204 may include information related to characteristics of the wine, information about the region the wine is from, information on recipes that pair well with the wine, wine varietal, coupons, vouchers, vouchers for wine tastings, or other information related to wine or goods.

According to some embodiments, information on sections 202*a-f* and information on center column 204 may be interrelated among any subset of or all sections of 202*a-f* and/or center column 204. For an embodiment with interrelated sections 202*a-f* and/or center column 204, sections 202*a-c* may include information related to wines or other goods included in the shipping container. Center column 204 may include a graphic of a map indicating the origin of the wines or other goods described in sections 202*a-c*. In addition, sections 202*d-f* may include recipes that suit or pair well with the wines or other goods described in sections 202*a-c*, or information on wine varietals in sections 202*a-c* that also interrelates to the origin information in center column 204. Embodiments are not limited to a specific subject matter of the information or how that subject matter is interrelated among any and all of sections 202*a-f* and/or center column 204. As such, embodiments include all of or a subset of sections 202*a-f* and center column 204 such that each one or a subset thereof may include information related to subjects including, but not limited to, characteristics of the wine, information about the region the wine is from, information on recipes that pair well with the wine, wine varietal, coupons, vouchers, vouchers for wine tastings, or other information related to wine or goods such that the information interrelates among any subset of or all of sections 202*a-f* and/or center section 204.

Figure 5:
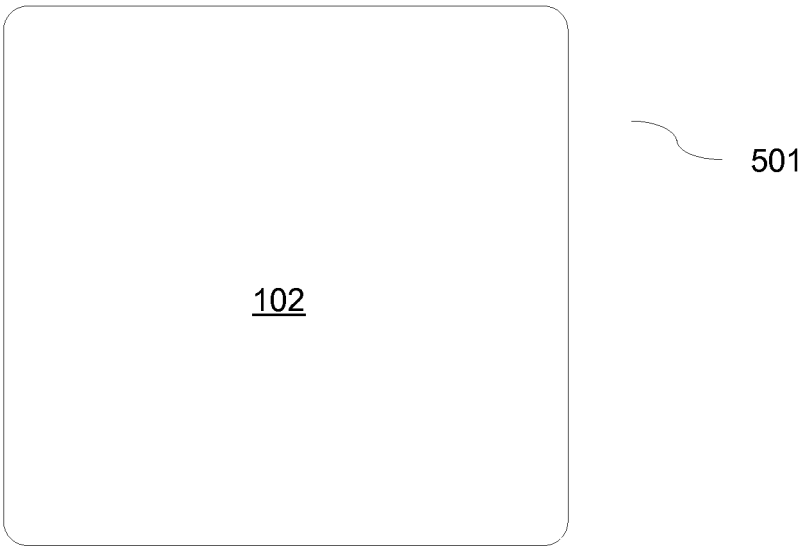
FIG. 5 illustrates an embodiment of an informative packaging and wrapping product having a square shape.

FIG. 5 illustrates an embodiment of an informative packaging and wrapping product 501 having a square shape. As such, the embodiments are not limited to square or rectangular shapes, but may also include any geometric shape including, but not limited to, a circular or other polygon shape.

Figure 6:
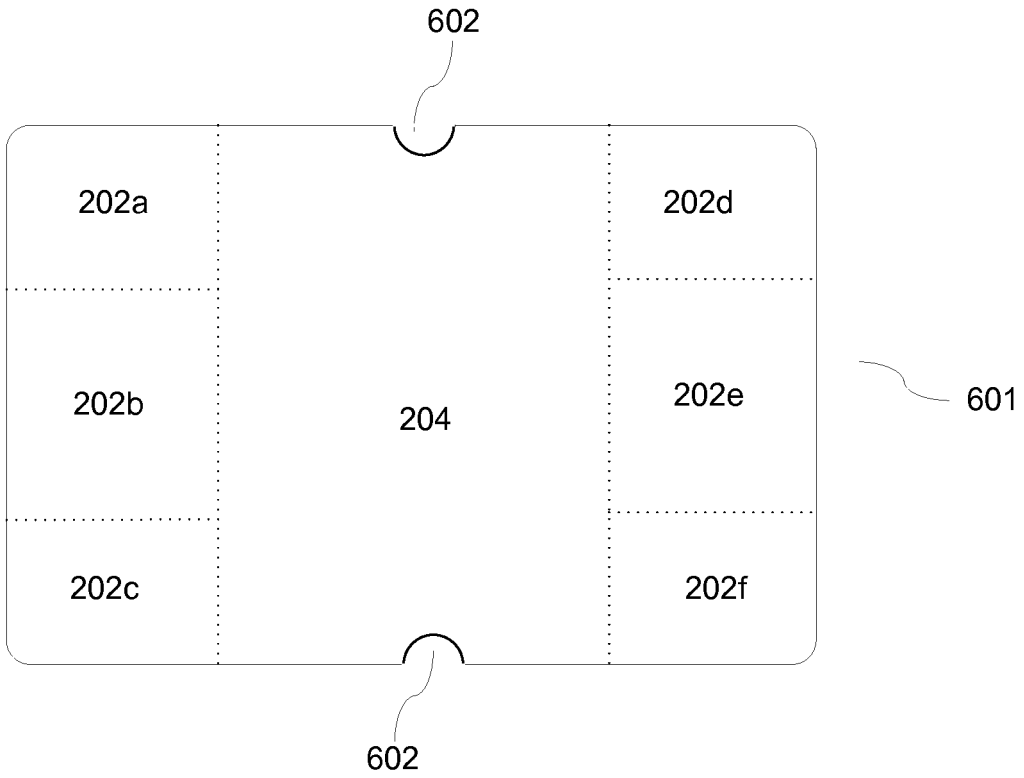
FIG. 6 illustrates an embodiment of an informative packaging and wrapping product including indentions.
Figure 7:
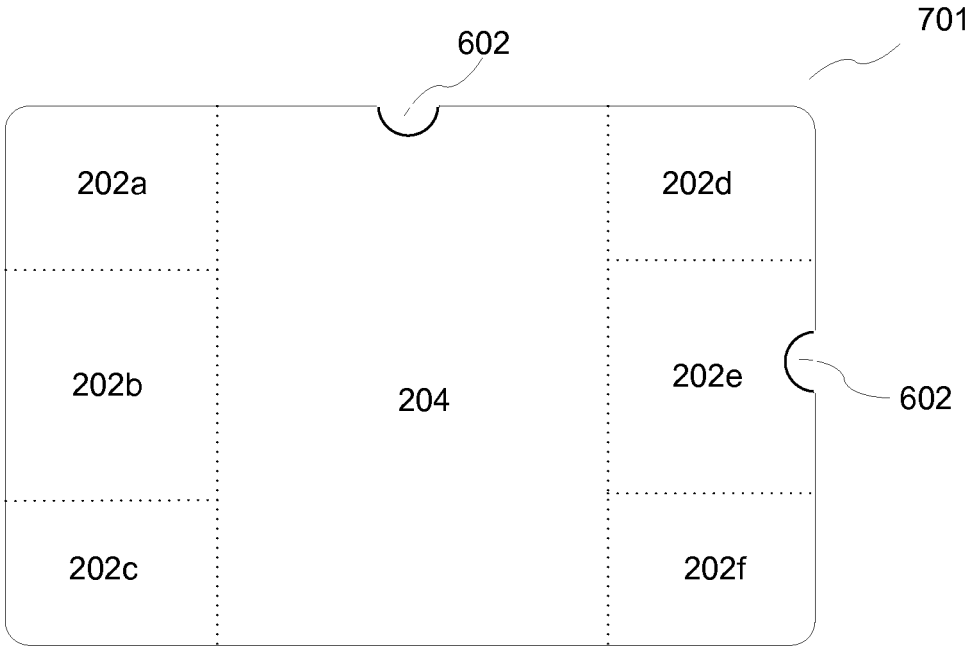
FIG. 7 illustrates another embodiment of an informative packaging and wrapping product including indentions.

FIG. 6 illustrates an embodiment of an informative packaging or wrapping product 601 having at least one indention 602 along a side. Such indentions 602 may be used to provide easy removal from a shipping container using a finger to reveal or gain access to the goods below. As such embodiments, of the informative packaging or wrapping product may be configured to cover most, if not all, of the goods and any packing materials contained within the shipping container. FIG. 7 illustrates another embodiment of an informative packaging or wrapping product 701 having two indentions 602. Embodiments of the informative packaging or wrapping product include any number of indentions along one or more sides of the informative packaging or wrapping product.

Figure 8:
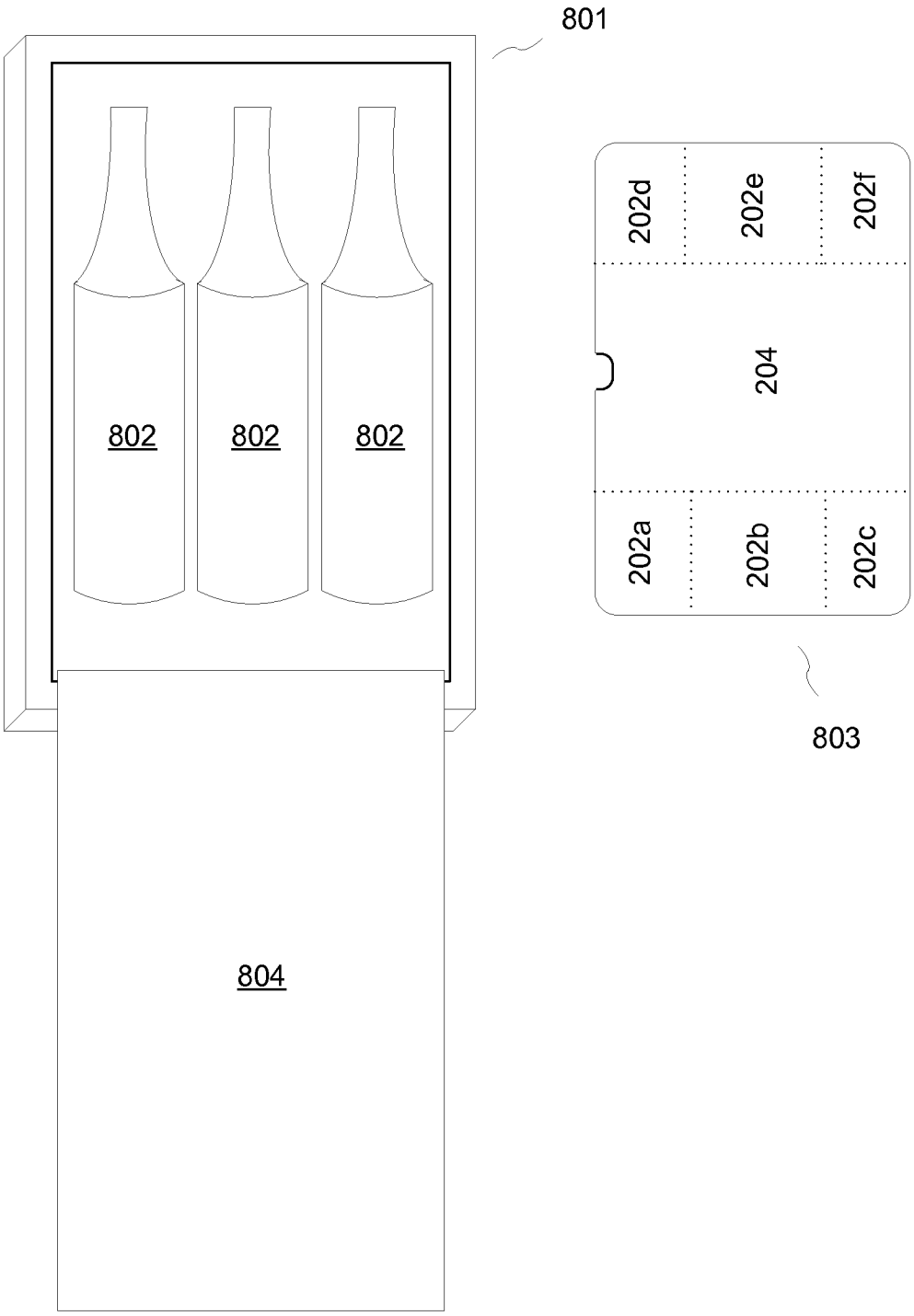
FIG. 8 illustrates an embodiment of a packaging system including a crate.

FIG. 8 illustrates a packaging system according to an embodiment. A packaging system, according to an embodiment, includes a shipping container and an informative packaging and wrapping product configured to reside within the shipping container over the goods. For the packaging system embodiment illustrated in FIG. 8, the shipping container is a wine crate 801 with lid 804 for storing or shipping goods, such as one or more wine bottles 802. For such an embodiment, the informative packaging and wrapping product is a packaging insert 803 configured to cover at least a portion of the one or more wine bottles 802 and any accompanying packaging. According to another embodiment the packing insert 803 may be configured to fit within the shipping container to completely cover the goods and any accompanying packaging.

Figure 9:
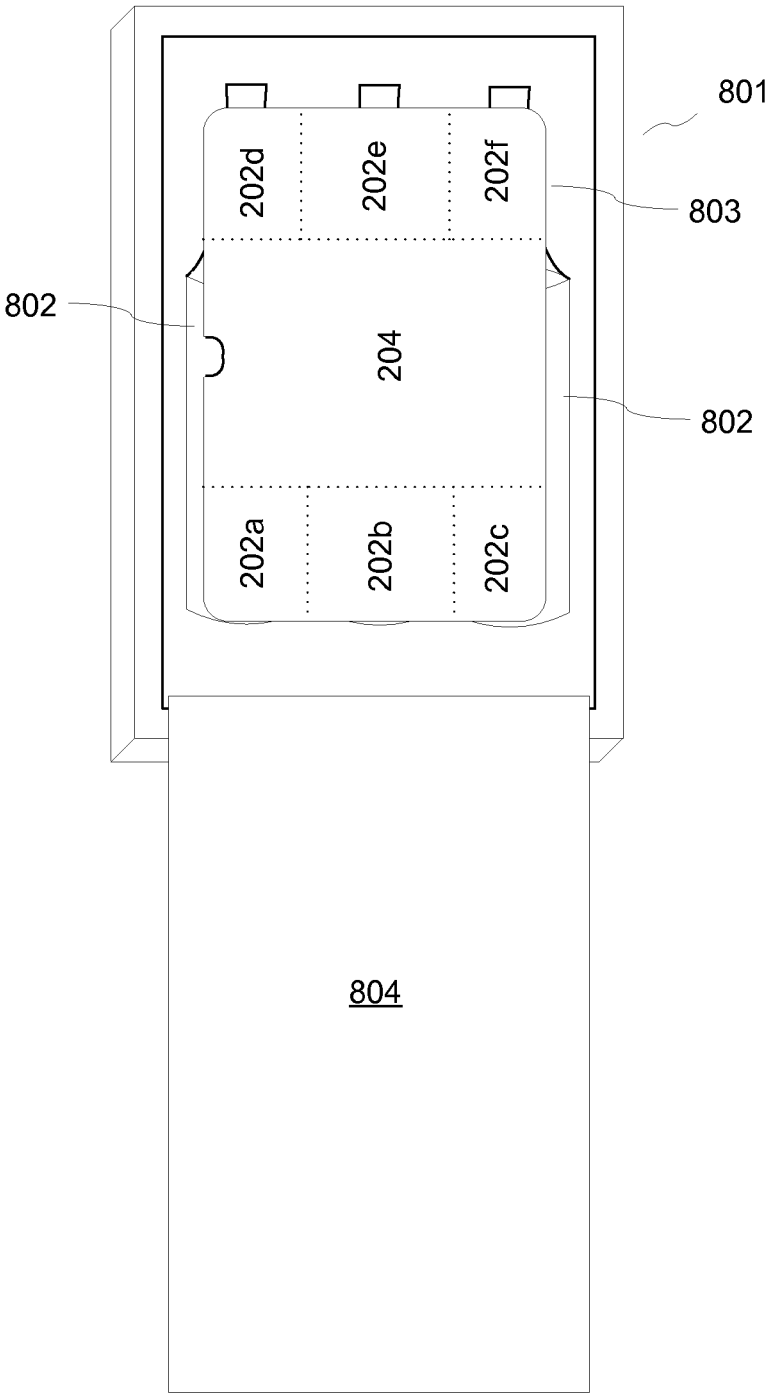
FIG. 9 illustrates an embodiment of a packaging system including a crate with an informative packaging and wrapping product installed to cover goods.

FIG. 9 illustrates an embodiment of a packaging system with the package insert 803 placed over the goods and configured to cover a substantial portion of the goods. For an example, covering a substantial portion of the goods includes covering more than 66 percent of the area of the goods visible from an opening in the shipping container. For embodiments covering a substantial portion of the goods, the informational packaging and wrapping product acts to maintain packaging materials surrounding the goods within the shipping container upon opening the shipping container. In addition, an embodiment of the informative packaging and wrapping product may be configured as a wrapping product, which includes the first surface 102 including a graphic that resembles a wrapped present and/or conveys a festive or congratulatory message.

Figure 10:
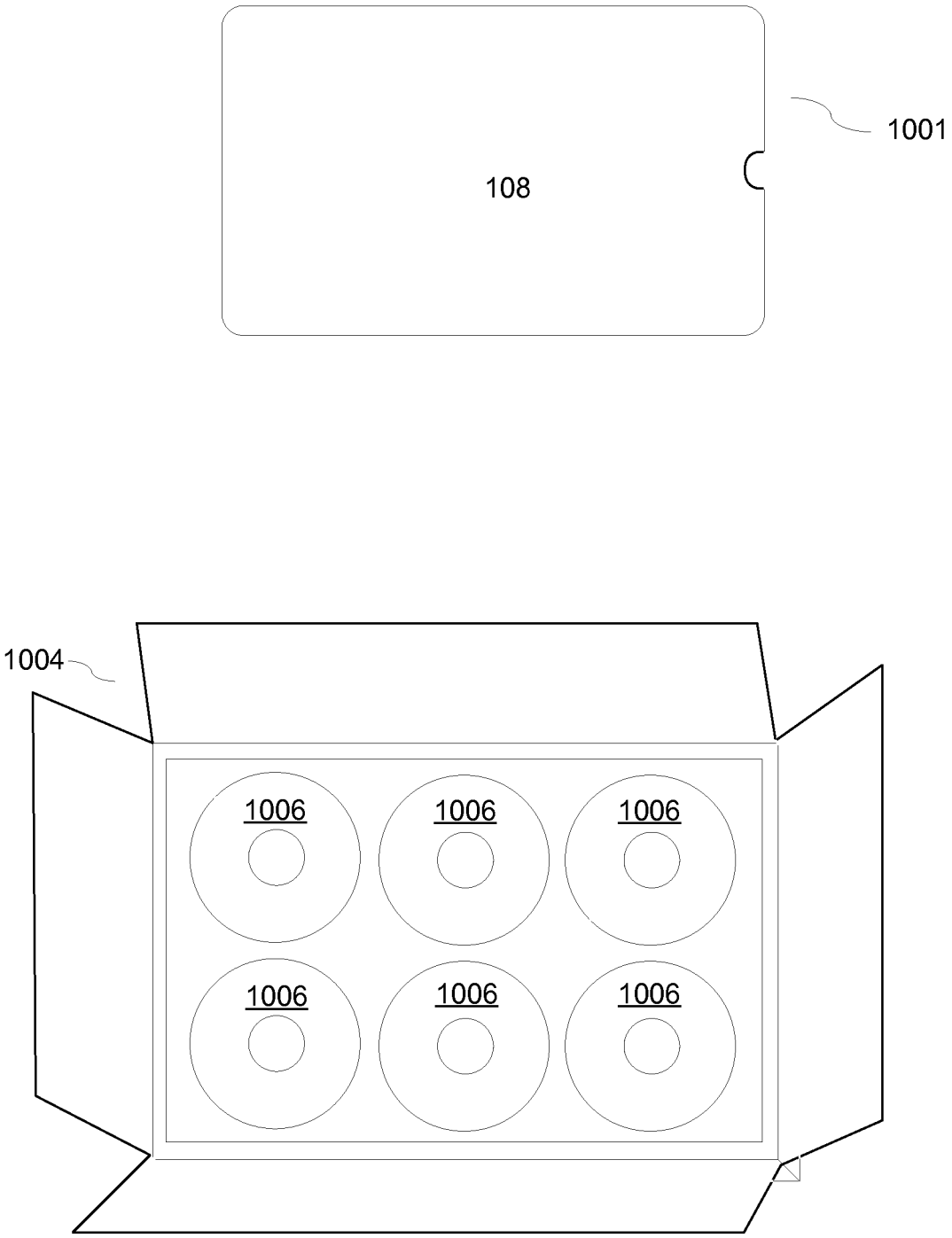
FIG. 10 illustrates an embodiment of a packaging system including a box.
Figure 11:
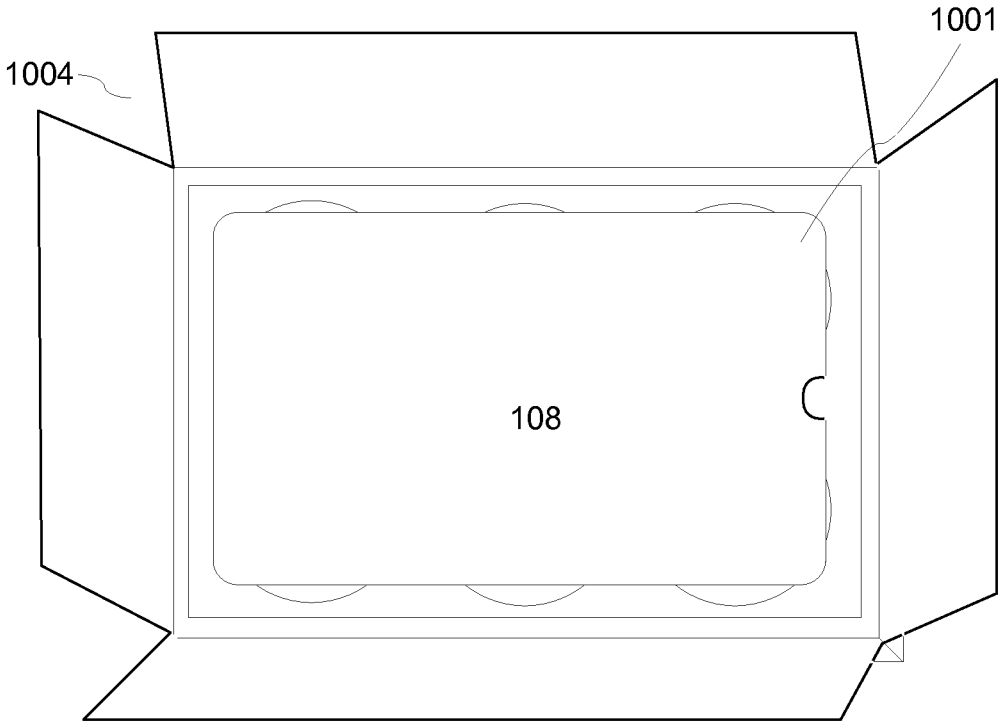
FIG. 11 illustrates an embodiment of a packaging system including a box with an informative packaging and wrapping product installed to cover goods.

FIG. 10 illustrates another embodiment of a packaging system including a shipping container and an informative packaging and wrapping product. For such an example, the shipping container is a box 1004 configured for shipping goods 1006, including, but not limited to, merchandizing, bottles, wine, wine related merchandizing, glasses, confectioneries, cheese, food, chocolates, gift boxes, wine bottles, beer bottles, or other types of bottles. The informative packaging and wrapping product is configured as a packaging insert 1001 to cover goods 1006. FIG. 11 illustrates an embodiment of an informative packaging and wrapping product configured to cover goods 1006 contained within the box 1004.

In the foregoing specification, specific exemplary embodiments of the invention have been described. It will, however, be evident that various modifications and changes may be made thereto. The specification and drawings are, accordingly, to be regarded in an illustrative rather than a restrictive sense.

What is claimed is:

1. A packaging system comprising:

a shipping container configured to receive goods through an opening in said shipping container; and a packaging insert configured to fit within said shipping container and configured to lay above and to cover at least a portion of said goods, said packing insert having a first side configured to be a first uniform surface including a first graphic and an second side configured to be a second uniform surface including at least a second graphic, and said packaging insert including an indention along a side of said packaging insert, said indention configured for use by a finger to gain access to the goods and said packaging insert configured into a first column of detachably connected sections, a second column of detachably connected sections, and a center column, said center column configured to reside between said first column of detachably connected sections and said second column of detachably connected sections.

2. The packaging system of claim 1, wherein said packaging insert is configured to have one or more informational sections.

3. The packing system of claim 1, wherein said first graphic is related to said goods.

* * * * *